US005947807A

United States Patent [19]

Overseth

[11] Patent Number: 5,947,807

[45] Date of Patent: Sep. 7, 1999

[54] APPARATUS FOR CLEANING AND POLISHING A SURFACE

[76] Inventor: Elmo R. Overseth, 4301 Chimney Lake Dr., Roswell, Ga. 30075

[21] Appl. No.: 09/088,389

[22] Filed: Jun. 1, 1998

Related U.S. Application Data

[62] Division of application No. 08/807,241, Feb. 28, 1997, Pat. No. 5,815,876, is a division of application No. 08/522,758, Sep. 1, 1995, abandoned.

[51] Int. Cl.[6] ..... B24D 11/00

[52] U.S. Cl. ..... 451/533; 451/539; 451/532; 451/359

[58] Field of Search ..... 451/523, 539, 451/530, 532, 353, 359, 398; 15/179, 98, 97.1, 207.2, 28, 209.1, 210.1, 227, 228, 230, 230.12, 230.15, 230.17, 230.18, 230.19

[56] References Cited

U.S. PATENT DOCUMENTS

| | | |
|---|---|---|
| 1,887,477 | 11/1932 | Slater . |
| 2,071,365 | 2/1937 | Stroop . |
| 2,508,799 | 5/1950 | Reis, Jr. . |
| 3,075,222 | 1/1963 | Miller . |
| 3,344,457 | 10/1967 | Grobert . |
| 3,346,904 | 10/1967 | Amstrong . |
| 3,357,033 | 12/1967 | Sawyer . |
| 3,466,691 | 9/1969 | Wessel . |
| 3,793,665 | 2/1974 | Thielen . |
| 4,250,586 | 2/1981 | Timian . |
| 4,593,427 | 6/1986 | Ortolivo . |
| 4,692,958 | 9/1987 | McMakin . |
| 4,912,800 | 4/1990 | Zeltner . |
| 5,003,659 | 4/1991 | Paepke . |
| 5,123,139 | 6/1992 | Leppert et al. . |
| 5,201,149 | 4/1993 | Eisenblatter . |
| 5,249,329 | 10/1993 | Arnold . |
| 5,375,289 | 12/1994 | Miyaoka . |
| 5,419,015 | 5/1995 | Garcia . |

FOREIGN PATENT DOCUMENTS

| | | |
|---|---|---|
| 2.196.820 | 3/1974 | France . |
| 33 15737 A1 | 10/1984 | Germany . |
| 33 39 603 A1 | 5/1985 | Germany . |
| 2-102232 | 4/1990 | Japan . |
| 5-146388 | 6/1993 | Japan . |
| 2016324 | 9/1979 | United Kingdom . |

*Primary Examiner*—David A. Scherbel
*Assistant Examiner*—Derrie Holt Banks
*Attorney, Agent, or Firm*—Deveau, Colton & Marquis

[57] ABSTRACT

A cleaning and polishing assembly having a compressible main body with a releasable attachment material on one face and a fibrous working surface on its other face. The fibrous working surface is composed of fibers having a trilobal cross-section. The cleaning and polishing pad can be mounted on a power drive tool, or in a hand-actuated embodiment, can be mounted to a gripping pad specially adapted for hand use.

4 Claims, 7 Drawing Sheets

APPARATUS FOR CLEANING AND POLISHING A SURFACE

This application is a divisional of Ser. No. 08/807,241 filed Feb. 28, 1997, which is now U.S. Pat. No. 5,815,876; and a divisional of Ser. No. 08/522,758 filed Sep. 1, 1995, which is now abandoned.

BACKGROUND OF THE INVENTION

1. Field of the Invention

The present invention relates generally to an apparatus for polishing, buffing, and/or cleaning a surface. The invention relates more specifically to such an apparatus which has a main cushioning body with a working surface comprising independent, non-tufted, flocked vertical fibers adhered thereon, and a second surface for attachment to a power drive tool or a hand-held gripping pad.

2. Description of Related Art

A variety of buffing or polishing pads have been developed for applying materials such as wax, polish, or buffing compounds to a surface and for removing such materials and buffing or polishing the surface, all of which have been found to suffer from one or more disadvantages. For example, many prior art buffing pads are very large, either in diameter or in thickness, or both. As a result, drive tools utilized with such pads must be large, unwieldy and heavy, often resulting in operator fatigue. These large pads also typically require some type of centering means of attachment, such as a bolt, to aid in securing the buffing pad to a backing plate portion of the drive tool. In use, such centering devices can come into contact with the surface being finished, and mar or scratch the surface. Furthermore, the large physical size of such prior art designs makes it difficult to utilize such devices on irregular surfaces such as found on automobile bodies, and therefore require considerable hand work to complete the task. Also, in order to prevent the mounting surfaces from coming into contact with the surface being worked, and thereby marring the surface, prior art devices often employ buffing surfaces which extend considerably outwardly beyond the peripheral edge of the backing plate of the drive tool, thereby failing to provide adequate support for the outer periphery of the buffing surface.

Furthermore, because many prior art designs are rigidly mounted to the backing plate portion of a drive tool, the buffing surface lacks flexibility and/or maneuverability when in use. This lack of flexibility of the buffing surface often results in uneven pressure across the buffing surface or reduction in contact area of the buffing surface with the surface being worked. This can result in scratching or burning of the surface being worked, or irregularities or scratches in surface appearance after polishing.

Many known buffing pad designs employ a buffing surface of cotton, wool, or other tufted (i.e., having looped fibers without exposed free ends) materials. Such materials trap dirt and spent buffing compounds in the fiber surface which can cause swirl or whorl marks in the finished surface. Such pads also have a tendency to mat when the surface becomes clogged with dirt and/or spend buffing compound, and require frequent changing of the pad as well as frequent cleaning, thereby further reducing productivity and increasing work time. Further, pads made from such materials are most effectively used in the buffing mode only, and are not effective as an applicator. Thus, separate pads made of different materials must be utilized for applying compounds, polishes, or waxes, resulting in downtime and loss of productivity as the pads are changed.

Prior art buffing pad assemblies are also difficult to clean. Those employing a tufted buffing surface cannot be brushed clean, as with a soft bristle brush, due to the looped nature of the fibrous surface, which loops act to retain dirt or spent buffing compounds within the buffing pad. The only effective cleaning means for such pad assemblies is by washing, which requires the assembly be removed from the backing plate of the drive tool thereby consuming time and reducing productivity.

It has also been found that known means for attachment of buffing, polishing, or cleaning pads to known drive tools suffer a variety of disadvantages. Often, tie strings are used to attach known buffing pads to the drive tool. However, this means of attachment is not positive, and can allow slipping between the buffing pad and the backing plate. If sufficient pressure is applied to the worked surface using this means of attachment, the backing plate can rotate inside the buffing pad without rotating the buffing pad on the worked surface. Buffing pads utilizing attachment means including a center bolt are also known, and have been found disadvantageous as removal and reattachment is difficult and time consuming. Moreover, as discussed above, such attachment bolts are disadvantageous as they may mar the surface during working.

It has also been found that prior art polishing, cleaning, and applicator pads having fibrous surfaces often lack sufficient fiber stiffness to prevent the fibers from bending and matting in use. For example, when the fibers are wet, or when buffing compounds or wax are applied, the individual fibers on the surfaces of known buffing pads flex when the pad is applied to the worked surface, and mat or cling to one another. When this occurs, the surface becomes flat or yarn-like, and does not function as intended. This requires frequent maintenance to keep the pad fibers clean. A dirty or matted pad can result in damage to the worked surface from excessive friction or heat.

For hand-actuated washing or polishing applications, a variety of cleaning and applicating devices are also known. For example, hand-held sponges or wash pads are known. Wash mitts which allow the user to insert a hand into the mitt's interior are also known. These known devices, however, also have been found to suffer a variety of disadvantages. For example, cleaning mitts are often difficult to place on the user's hand, and generally provide no stiffness to the cleaning surface, thereby resulting in uneven pressure along the worked surface. Also, known cleaning mitts and sponges often sink when placed into a container of cleaning solution, thereby allowing the mitt or sponge to contact dirt which has settled to the bottom of the container, which dirt can be picked up on the mitt or sponge, and result in scratches on the work surface. Also, known wash mitts and cleaning pads for hand use typically have a looped or tufted outer surface which, as described above, does not lend itself to easy cleaning, and which has also been found to catch or snag on surface protrusions such as decals, often causing damage to the worked surface. The size and thickness of such known devices also limits their effectiveness in cleaning irregular surfaces, particularly tight or narrow spaces such as around the bumpers, doors, door handles, etc. of an automobile. The man-made sponges also cut easily and are generally short-lived.

Thus, it can be seen that a need exists for a device which can be used for cleaning, buffing, or polishing a surface, which device can be readily attached to and removed from a drive tool A need further exists for such a device which is easy to clean. A further need exists for such a device which maintains substantially all of its working surface in contact with the worked surface, regardless of slight misalignments between the drive tool and the worked surface.

It can also be seen that a need exists for a hand-actuated device which allows the cleaning, polishing and application of a variety of materials to a worked surface. A need further exists for such a device which is easy to place on the operator's hand, and which is comfortable in use, with either the left or right hand of the operator, and which eliminates or minimizes the above-described disadvantages.

It is to the provision of an apparatus meeting these and other needs that the present invention is primarily directed.

BRIEF SUMMARY OF THE INVENTION

Briefly described, in a preferred form, the present invention comprises an apparatus which can be used to apply a variety of materials, such as cleaning or buffing compounds to a worked surface, to clean a surface, and/or to polish or otherwise treat the worked surface. The apparatus generally comprises a main cushioning body having an attachment surface for attachment to an actuating means such as a power drive tool or a hand-held gripping pad. The main cushioning body further comprises a flocked surface opposite the attachment surface, for washing, polishing, or otherwise working the worked surface. Throughout this specification, the term "flocked" is intended to refer to a fibrous surface having a multiplicity of fibers with a free end exposed, as opposed to a "tufted" or "looped" surface wherein both ends of the fibers are attached.

In a first described embodiment, the apparatus of the present invention comprises a cleaning or polishing disk adapted to be attached to a power drive tool. In a second described embodiment, the device of the present invention comprises a cleaning or polishing pad adapted to be attached to a hand-held gripping pad, for hand actuation.

The apparatus of the present invention may be used for cleaning or polishing a variety of surfaces to create or enhance a surface sheen that is free from whorls., burns, mars, and other surface defects and/or for applying materials such as, but not limited to: waxes, cleaners, polishes, and compounds. The apparatus of the present invention can be utilized with a variety of surfaces such as, but not limited to paint, tile, wood, fiberglass, glass, metal, whether the surface be flat or irregular.

Accordingly, it is an object of the present invention to provide an apparatus for cleaning, polishing, or applying various materials to a worked surface, which apparatus comprises an easily cleaned, flocked, fibrous working surface comprising a multiplicity of fibers having sufficient bending stiffness to resist matting and clumping.

It is a further object of the present invention to provide such an apparatus which can be readily attached to and detached from a power drive tool having a wide range of operating speeds up to at least 12,000 rpm, and which, due to its flocked working surface, will not mar or bum the worked surface while operating at high speeds.

Still another object of the present invention is to provide such an apparatus which eliminates the need for bolt assisted attachment means to the drive tool, and which does not require the use of a centering means for alignment on a backing plate portion of such drive tool, and which is sufficiently light in weight to prevent out-of-balance problems when driven at high speeds, even when installed on the drive tool backing plate somewhat off-center.

Yet another object of the present invention is to provide such an apparatus, the body of which is sufficiently stiff to maintain the outer peripheral edges of the working surface in contact with the worked surface, without the need for additional strengthening or stiffening members such as control ribs, and yet is sufficiently flexible to allow use with irregular worked surfaces, and which maintains substantially the entire working surface in contact with the worked surface even when the drive tool is somewhat out of alignment with the worked surface.

It is a further object of the present invention to provide such an apparatus which, by means of its flocked vertical fibers, conserves applied materials such as waxes, cleaners, polishes, and buffing compounds, and which minimizes slinging of such materials in use, even at high speed.

It is also an object of the present invention to provide a hand-held cleaning and polishing apparatus which allows easy and comfortable use by an operator, in either a left-handed or a right-handed configuration.

It is a further object of the present invention to provide such a hand-held apparatus which permits quick and easy interchangability between a variety of working surface pads, as may be necessary for different applications.

It is a further object of the present invention to provide such a hand-held apparatus which will float in a container of water for easy cleaning and retrieval, and to prevent contaminating the working surface of the apparatus with dirt which may have settled to the bottom of the container.

Still another object of the present invention is to provide such a hand-held apparatus which provides firm but flexible support to the working surface as it is applied to the worked surface in use, and which maintains a generally flat relationship of the working surface against the worked surface being cleaned or polished, despite minor misalignments of the actuating means and the worked surface, for maximum effectiveness.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF A PREFERRED EMBODIMENT

Figure 1:
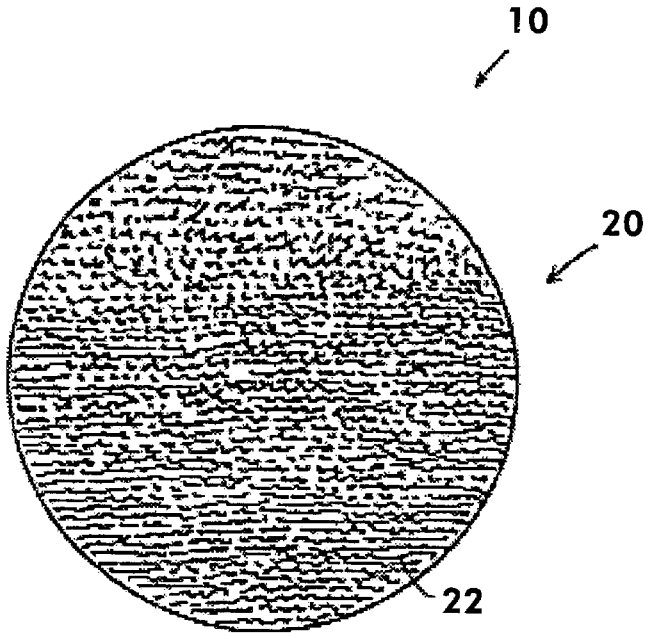
FIG. 1 is a top plan view of a first embodiment of the cleaning and polishing pad of the present invention, which may be attached to a power drive tool
Figure 2:
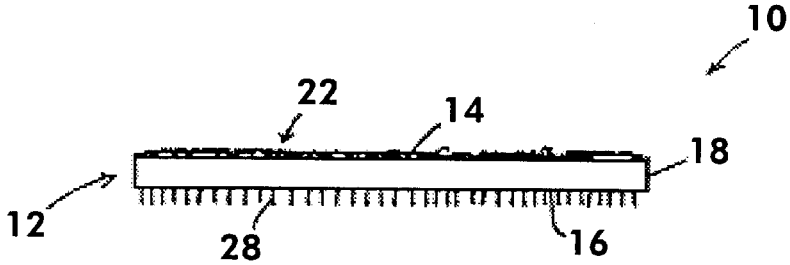
FIG. 2 is a side elevational view of the pad shown in FIG. 1.
Figure 3:
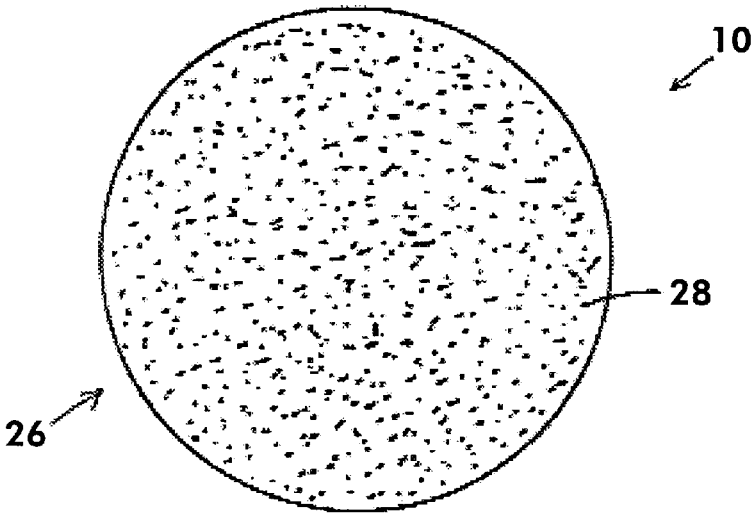
FIG. 3 is a bottom plan view of the pad shown in FIG. 1.

Referring now in detail to the drawing figures, wherein like reference numerals represent like parts throughout the several views, FIGS. 1–3 show a first embodiment of the present invention, according to a preferred form The cleaning and polishing pad 10 of the depicted embodiment preferably comprises a generally disk-shaped main body portion 12 having a top surface 14, a bottom surface 16 and an edge 18. The main body portion 12 is preferably fabricated from a non-reticulated, open-cell, polyester foam, such as Uniform 1.8 C available from Wm. T. Burnett & Co., Inc. of Baltimore, Md., or of other foam material such as polyethers, various reticulated foams, or felted foams, or of other materials of sufficient compressibility and resilience. The thickness and compressibility of the main body portion 12 are preferably selected to enable portions of the main body portion to deform under hand pressure when in use, in order to maintain the working face of the cleaning and polishing pad 10 substantially in contact with the worked surface to compensate for irregular surface contours and/or minor misalignments between the cleaning and polishing pad 10 and the worked surface.

In preferred form, the top surface 14 of the main body portion 12 of the cleaning and polishing pad 10 comprises an attachment face 20 for enabling releasable attachment between the cleaning and polishing pad 10 and the means for actuating the cleaning and polishing pad to move along the worked surface to be cleaned or polished. Preferred embodiments of the means for actuating are described in greater detail below, and may include a power drive tool, or a gripping pad for hand-actuation. The attachment face 20 is preferably provided with a releasable attachment means for attaching the cleaning and polishing pad 10 to the actuating means. Most preferably, the releasable attachment means comprises a hook-and-loop fastening system, such as Velcro®. Alternatively, pressure sensitive adhesives or other releasable attachment means can be utilized. A first element 22 of the hook-and-loop fastening system is secured to the top surface 14 of the main body portion by flame lamination, by adhesives, or by other permanent, waterproof attachment means. The second element 24 of the hook-and-loop fastening system is provided on the actuating means, as described in greater detail below.

As seen best in FIGS. 2 and 3, the bottom surface 16 of the main body portion 12 preferably comprises a working face 26 comprising a multiplicity of independent, non-tufted, flocked, irregularly-spaced vertical fibers 28. Throughout this specification, the term "flocked" is intended to describe fibers having a first end attached to a substrate, such as the main body portion 12, and a second free end. This is in distinction to a "tufted" or "looped" fiber having each end attached to a substrate, and an intermediate portion or loop extending outwardly from said substrate. The provision of a flocked fiber surface has been found advantageous over tufted or looped fibrous surfaces, as the flocked fibers facilitate more easy removal of dirt and/or spend polishing and cleaning compounds from the fiber surface, prevents matting of the fibers, and produces better results in cleaning and polishing without scratching, burning or otherwise marring the worked surface. The fibers 28 are preferably attached to the bottom surface 16 of the main body portion, generally perpendicular to the bottom surface 16, by applying a fluid binder type adhesive to the bottom surface 16, electrostatically charging the fibers, and applying the electrostatically charged fibers to the adhesive-coated bottom surface 16. In the preferred embodiment, the fibers 28 are approximately 0.180 inches in length, and approximately 18 denier (18 g/9,000 m of fiber length).

Figure 11:
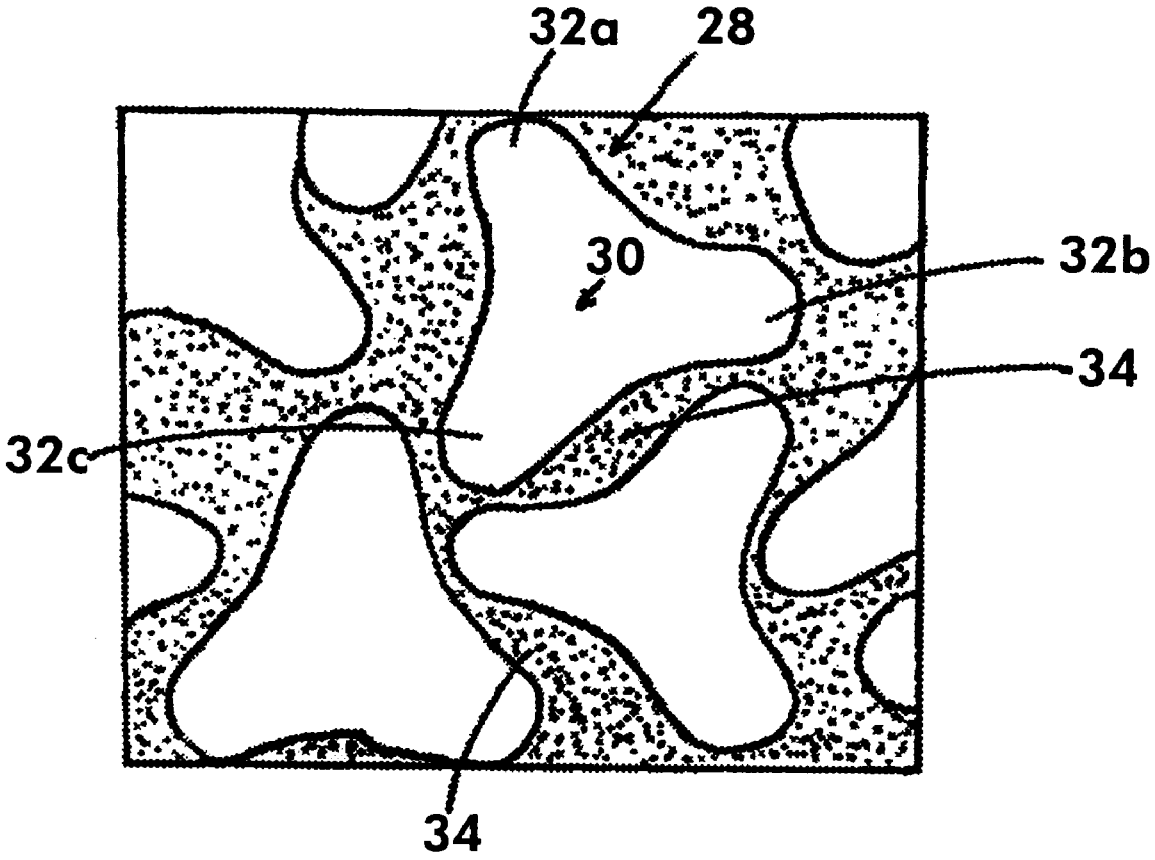
FIG. 11 is a detailed cross-sectional view showing the fiber configuration of the pad of the present invention, according to a preferred form

The fibers 28 of the present invention are preferably a trilobal fiber as shown in cross-sectional detail by FIG. 11. The trilobal fibers 28 are of generally triangular cross-section, having a central portion 30 and three lobes 32*a*, 32*b*, 32*c* extending therefrom. The trilobal cross-sectional geometry of the fibers 28 has been found to provide the fibers 28 with improved stiffness and resistance to bending in use. In this manner, the fibers stay more upright in use than conventional fibers, resisting matting and facilitating easier cleaning. The geometry and irregular spacing between the trilobal fibers 28 also improves air circulation through the working face 26 of the cleaning and polishing pad 10, thereby preventing the buildup of heat which can burn or otherwise mar painted surfaces.

The random spacing of the fibers 28, along with their trilobal geometry also creates a multiplicity of randomly-sized interstitial voids 34 between the fibers, which function to retain cleaning and buffing compounds within the fibers, and prevent waste of such materials due to slinging during use. In cleaning applications, the interstitial voids also function to contain dirt removed from the worked surface in a position away from the outer ends of the fibers 28 which form the working face 26, thereby minimizing or eliminating the possibility of said dirt scratching or marring the worked surface. The trilobal fibers of the preferred embodiment of this invention can be made from synthetic fibers such as acrylic, polyesters, nylon, rayon, etc. Although other multilobal fibers or non-lobal natural or synthetic fibers could be utilized in similar fashion, trilobal fibers, as described above, have been found most preferable, as they provide improved bending resistance and result in interstitial voids of favorable size and shape.

Figure 12:
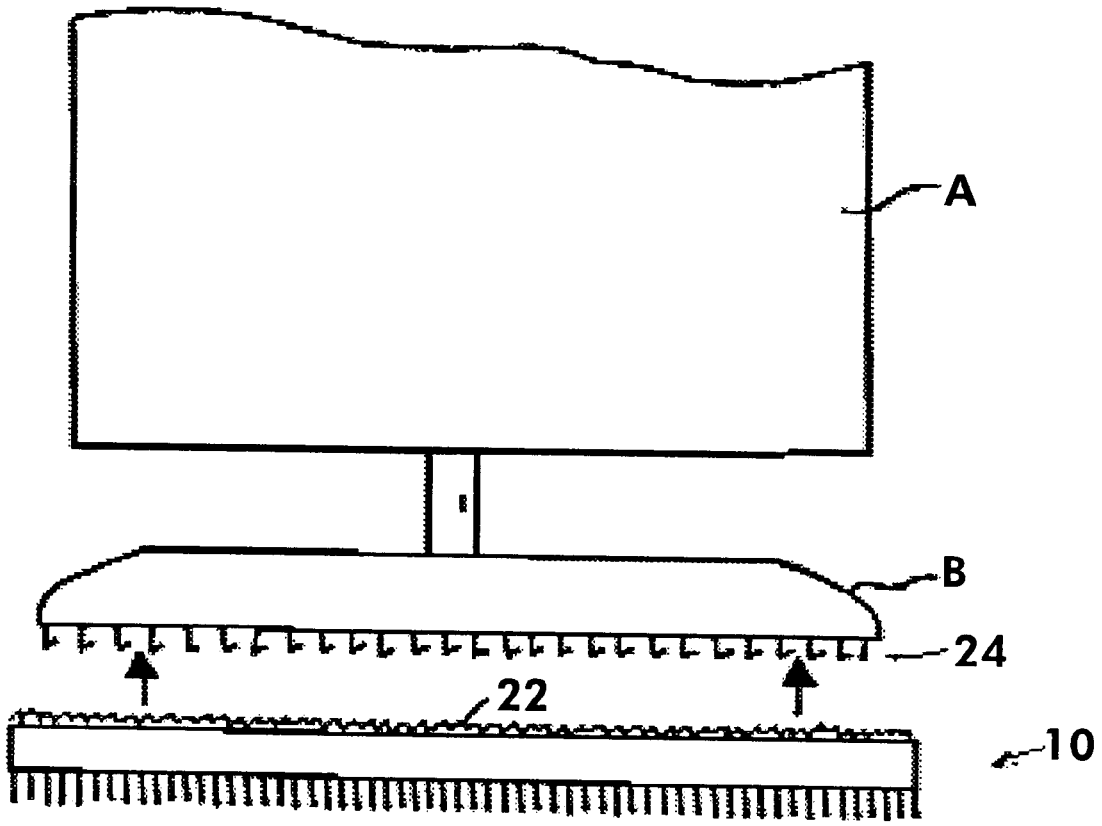
FIG. 12 is a side elevational view of one embodiment of the present invention, showing the manner in which the apparatus of the present invention may be attached to a power drive tool.

In use, the cleaning and polishing pad 10 is preferably releasably attached to an actuating means such as a power drive tool A, as shown by FIG. 12. The power drive tool can be, for example, an orbital sander or buffer, or a drill motor. The power drive tool A generally will comprise a backing plate B provided with the second element 24 of a hook-and-loop fastening system, to enable releasable attachment between the cleaning and poling pad 10 and the actuating means.

Figure 4:
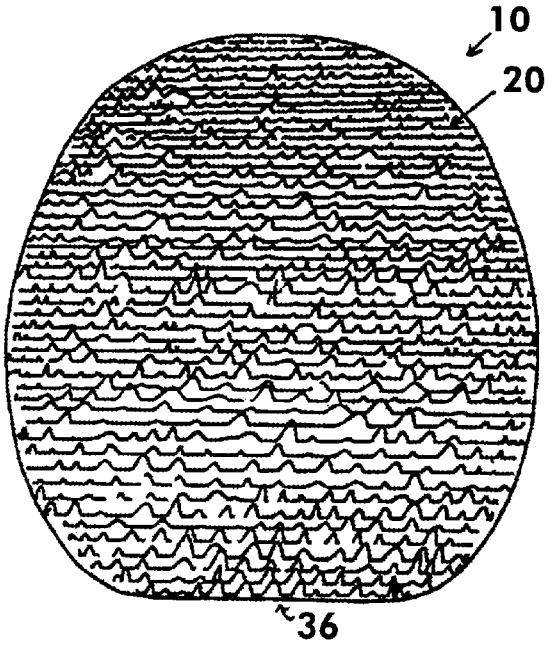
FIG. 4 is a top plan view of the cleaning and polishing pad portion of a hand-held embodiment of the present invention.
Figure 5:
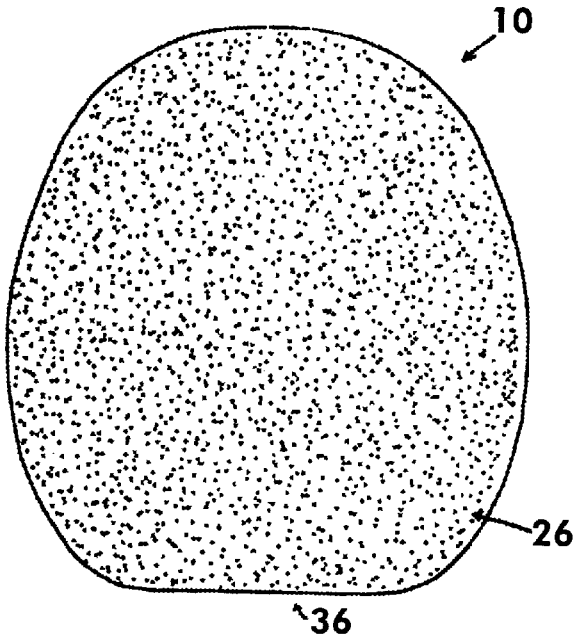
FIG. 5 is a bottom plan view of the pad shown in FIG. 4.
Figure 6:
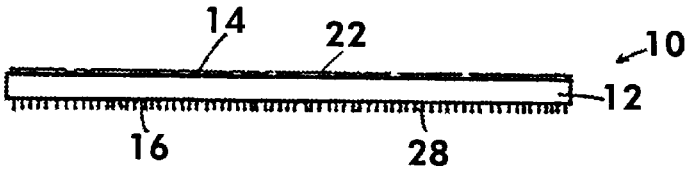
FIG. 6 is a side elevational view of the pad shown in FIG. 4.
Figure 7:
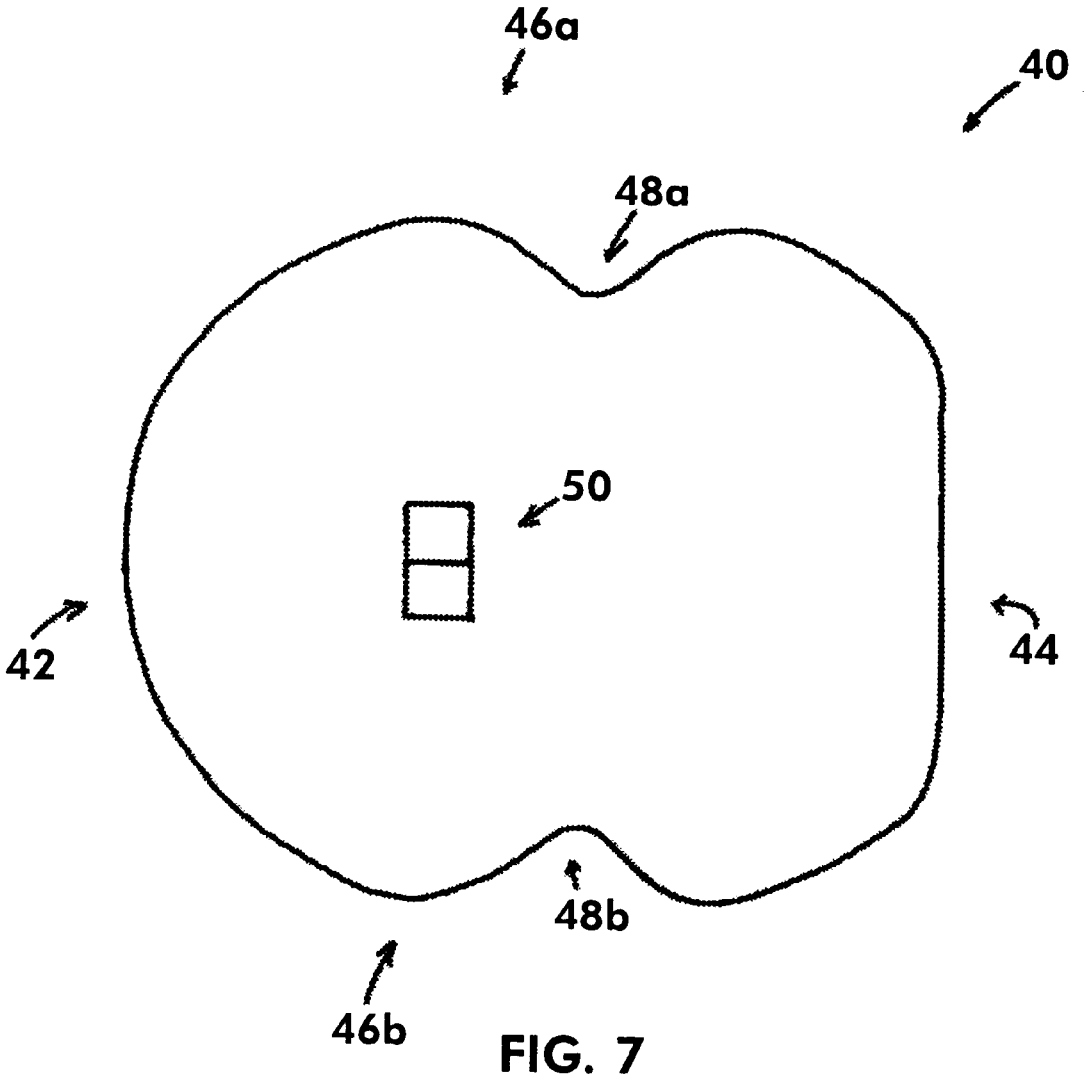
FIG. 7 is a top plan view of a hand-held gripping pad portion of the hand-held embodiment of the present invention.
Figure 8:
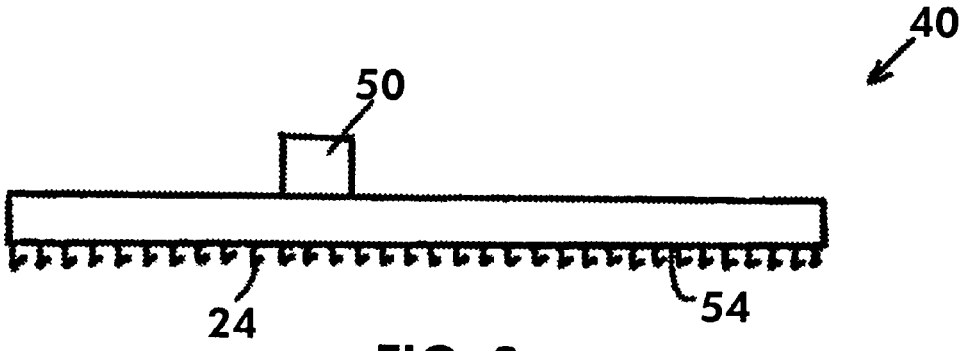
FIG. 8 is a side elevational view of the gripping pad shown in FIG. 7.
Figure 9:
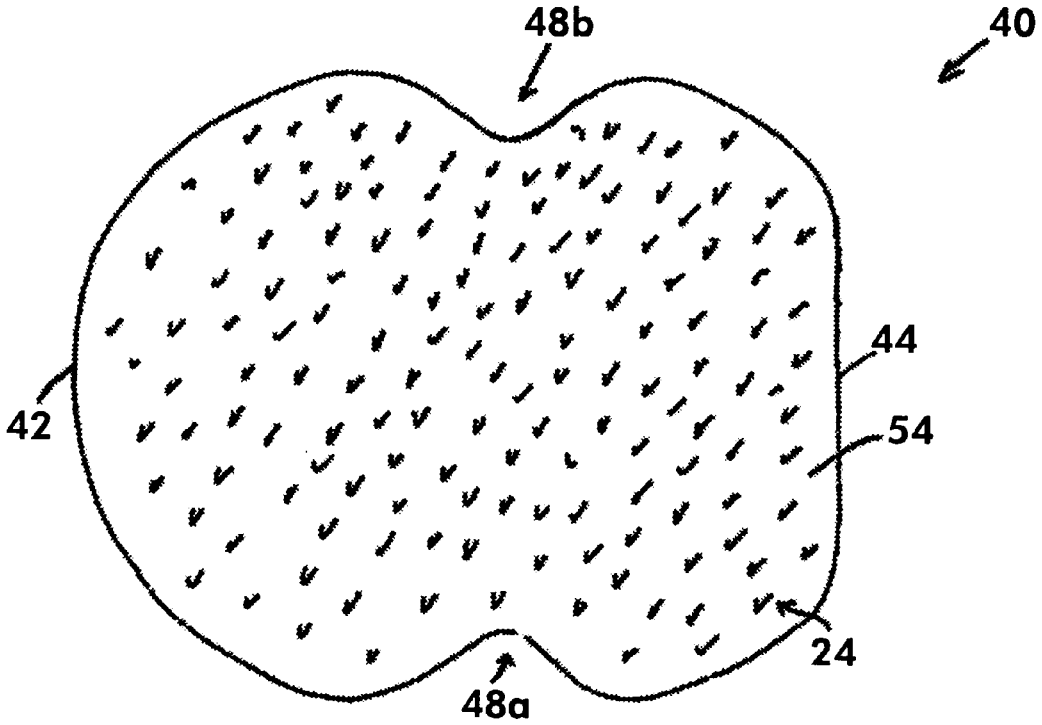
FIG. 9 is a bottom plan view of the gripping pad shown in FIG. 7.
Figure 10:
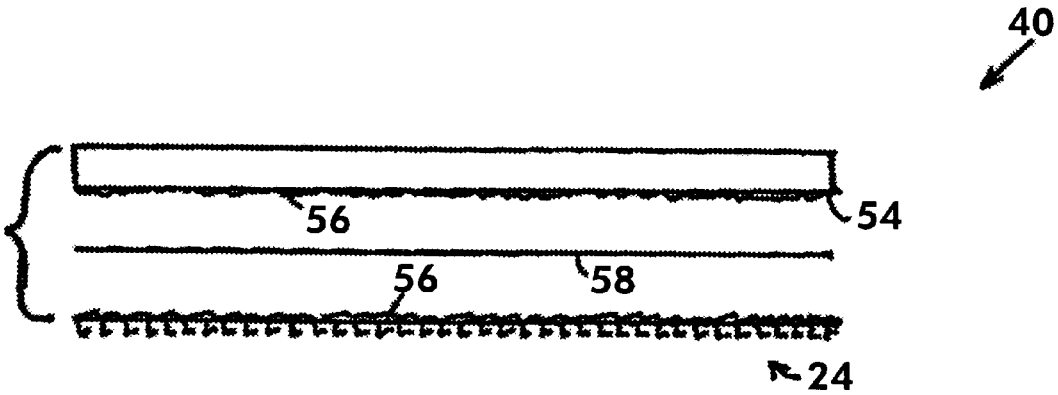
FIG. 10 is an exploded side elevational view of a portion of the gripping pad shown in FIG. 7.

In a second preferred embodiment of the present invention, the cleaning and polishing pad 10 can be adapted for hand actuation, as shown best in FIGS. 4–6. The materials and manner of construction of the hand-actuated cleaning and polishing pad 10 of this embodiment are similar to those described above. The top surface 14 of the main body portion 12 of the hand actuated cleaning and polishing pad 10 comprises an attachment face 20, preferably comprising a first element 22 of a hook-and-loop fastening system, for releasable attachment to a hand-actuated gripping pad which will be further described below. The bottom surface 16 of the main body portion 12 comprises a working face 26, preferably comprising a multiplicity of trilobal fibers 28 as described above.

In its preferred form, the cleaning and polishing pad 10 of the hand-actuated embodiment of the present invention is generally oval in shape, as shown best by FIGS. 4 and 5, and has dimensions adapted to circumscribe the outer periphery of a typical human hand. The hand-actuated embodiment of the cleaning and polishing pad 10 of the present invention is preferably provided with a truncated or flat heel portion 36 to provide clearance for wrist movement by an operator utilizing the cleaning and polishing pad 10 as described in greater detail below.

Figure 13:
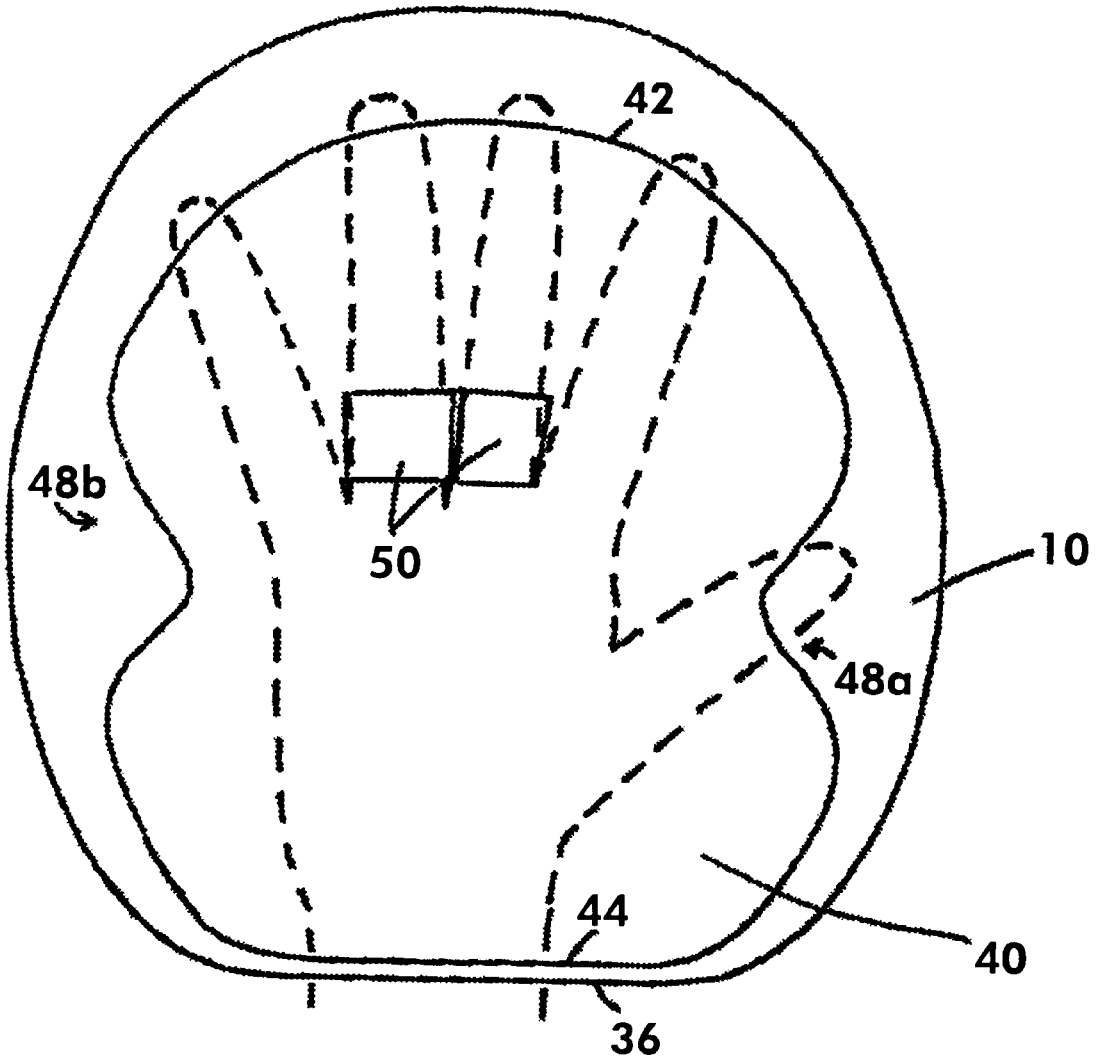
FIG. 13 is a top plan view of a preferred form of the hand-held embodiment of the present invention showing the gripping pad attached to the working pad.

FIGS. 7–10 show a gripping pad 40, according to preferred form of the present invention, for use in connection with the hand-actuated embodiment of the cleaning and polishing pad 10 described above. The gripping pad 40 is preferably generally oblong, having a geometry generally conforming to the shape of a human hand from the wrist to the end of the fingers. FIG. 13 shows the outline of a typical human hand in broken lines, grasping the gripping pad 40. The gripping pad 40 has a generally rounded first end 42 to conform to the ends of the fingers of a human hand gripping the gripping pad 40. The second end 44 of the gripping pad 40 is generally straight, to provide clearance for wrist movement in use, as will be described in greater detail below. Each side 46*a*, 46*b* of the gripping pad 40 comprises a thumb notch 48*a*, 48*b* to accommodate the operator's thumb in left-handed or right-handed use, respectively. One or more finger loops 50 are preferably provided to engage the operator's fingers in use.

The main body of the gripping pad is preferably constructed of a closed-cell foam material such as Ensolite vinyl nitrile foam, having a thickness of approximately ¼ inch (0.25"). The gripping pad 40 preferably has a density of 3.5–5.0 lb./cu. ft. and a maximum later absorption rate of 0.1 lb./sq. ft. The finger loops 50 are preferably fabricated from a woven elastic material, and are attached to the body of the gripping pad 40 by stitching, by adhesive, or by other waterproof attachment means. The bottom face 54 of the gripping pad 40 preferably comprises the second element 24 of the releasable attachment means which, in preferred form, comprises a hook-and-loop fastening system. As shown best in FIG. 10, the second element 24 of the releasable attachment means is preferably secured to the bottom face 54 of the gripping pad 40 by adhesives 56. A layer of scrim material 58 can be placed between the bottom face 54 of the gripping pad 40 and the top face of the second element 24 of the hook-and-loop fastening system, to provide a more secure and permanent attachment. The adhesives 56 utilized to join the components of the present invention should be of a waterproof variety.

Figure 14:
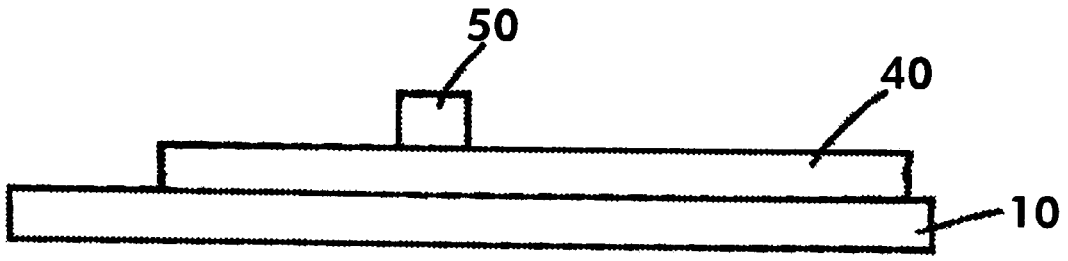
FIG. 14 is a side elevational view of a preferred form of the hand-held embodiment of the present invention shown in assembled form.

The preferred manner of use of the hand-actuated cleaning and polishing pad 10 of the present invention will now be described. As shown best by FIGS. 13 and 14, the gripping pad 40 is pressed onto the cleaning and polishing pad 10, with the second element 24 of the hook-and-loop fastening system (provided on the bottom face 54 of the gripping pad 40) securely but releasably engaging the first element 22 of the hook-and-loop fastening system (provided on the top surface 14 of the cleaning and polishing pad 10). As shown best by FIG. 13, the second end 44 of the gripping pad 40 is placed adjacent and in general alignment with the heel 36 of the cleaning and polishing pad 10.

The operator may then grasp the assembly by inserting his or her fingers through the one or more finger loops 50. The outline of a typical human hand is depicted in broken lines by FIG. 13, and shows the preferred manner of grasping the gripping pad 40. The operator's fingertips preferably extend just over the rounded first end 42 of the gripping pad 40, to provide improved dexterity and control of the assembly in use. The operator's thumb preferably rests in one of the thumb notches 48*a*, 48*b* provided along the sides 46*a*, 46*b* of the gripping pad 40, for control and comfort. As depicted in FIG. 13, the thumb of an operator's left hand rests in the thumb notch 48*a*. However, it will be understood that in right-handed use, the operator's right thumb would rest in similar fashion in the thumb notch 48*b*.

Because the heel 36 of the cleaning and polishing pad 10 and the second end 44 of the gripping pad 40 are generally flat, the apparatus of the present invention does not interfere with flexing of the operator's wrist in use. Because of the releasable attachment between the gripping pad 40 and the cleaning and polishing pad 10, the gripping pad 40 may be attached at various locations along the attachment face 20 of the cleaning and polishing pad 10, as desired to provide improved control and comfort during use. For example, operators with larger hands may find the apparatus more comfortable to use and easier to control if the gripping pad 40 is placed on the cleaning and polishing pad 10 closer to the heel 36. By contrast, operators with smaller hands may prefer to move the gripping pad 40 to a position somewhat removed from the heel 36 and more centered on the polishing pad.

In use, the hand actuated gripping pad is readily changeable from one cleaning and polishing pad to another, as may be necessary for different applications. For example, the gripping pad 40 may be affixed to a first cleaning and polishing pad 10 which is used to wash an automobile with a cleaning solution such as detergent and water. The cleaning pad 10 may then be detached from the gripping pad, and a second applicator pad mounted to the gripping pad 40 for applying wax or other polishing compound to the automobile. This applicator pad may then be detached and a third pad mounted to the gripping pad 40 for buffing the automobile. Because the gripping pad 40 is preferably fabricated from a closed-cell material, as described above, it does not readily absorb liquids and, therefore, can be quickly switched between pads for each mode of use.

Because the cleaning and polishing pad 10 of the present invention comprises an open-cell foam, whereas the gripping pad 40 comprises a closed-cell foam, when the assembly of the gripping pad 40 and cleaning and polishing pad 10 is dropped into a container of cleaning solution, such as a bucket of soapy water, the greater water absorption rate of the open-cell foam of the cleaning and polishing pad 10 will tend to cause the assembly to turn into a position wherein the assembly floats with the gripping pad 40 at the water's surface, and the cleaning and polishing pad 10 submerged with its bottom surface 16 facing downward. In this manner, dirt trapped between the fibers 28 within the working face 26 of the cleaning and polishing pad 10 will tend, under the influence of gravity, to be released into the cleaning solution and fall to the bottom of the container. Because the gripping pad 40 will tend to float and keep the assembly at or near the surface of the cleaning solution, the cleaning and polishing pad 10 will not fall to the bottom of the container where it might again pick up the dirt which has fallen to the bottom of the container. The clean solution near the top of the container is always being utilized to contact the surface being cleaned or worked.

The flocked nature of the fibrous working surface 26 of the cleaning and polishing pad 10 of the present invention promotes the escape of dirt and spend buffing compounds from the pad. For example, when the cleaning and polishing pad 10 of the present invention is placed into a container of cleaning solution with the fibers 28 pointing downwardly, dirt and/or spent cleaning and buffing compounds will readily release from the working face 26 of the cleaning and polishing pad 10 into the cleaning solution. The flocked fiber working face 26 of the cleaning and polishing pad 10 of the present invention can also be cleaned in a dry state, as by brushing, scraping or shaking the cleaning and polishing pad 10 to release dirt and other materials from the working face 26. Further, the motion of the cleaning and polishing pad 10 during operation will, to some extent, release dirt and other materials from the working face 26, as the flocked fibers 28 do not have loops or other obstacles which could resist the release of dirt or other materials therefrom While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An apparatus for cleaning and polishing a worked surface, said apparatus comprising:

(a) a cleaning and polishing pad for contacting the worked surface, said cleaning and polishing pad comprising a main body portion having an attachment face, a working face opposite said attachment face and a compressible portion between said attachment face and said working face, said working face comprising a multiplicity of trilobal fibers for contacting the worked surface;

(b) means for actuating said cleaning and polishing pad to move along the worked surface; and (c) releasable attachment means for releasably attaching said cleaning and polishing pad to said means for actuating;

wherein said means for actuating comprises a drive tool having a backing plate, and said releasable attachment means comprise a hook-and-loop fastening system comprising first and second elements which releasably engage one another, said first element being applied to said backing plate, and said second element being applied to said attachment face.

2. The apparatus of claim 1, wherein said compressible portion has a thickness sufficient to permit portions of said working face to deform obliquely relative to said attachment face under hand pressure.

3. The apparatus of claim 2, wherein said multiplicity of trilobal fibers are approximately 0.180 inches in length and approximately 18 denier.

4. The apparatus of claim 3, wherein said multiplicity of trilobal fibers are randomly spaced apart from one another to create a multiplicity of randomly sized interstitial voids.

* * * * *